US005692252A

United States Patent [19]

Zwezdaryk

[11] Patent Number: 5,692,252

[45] Date of Patent: Dec. 2, 1997

[54] DUAL SHOWER FIXTURE

[76] Inventor: Shane Zwezdaryk, 46 Hyde Avenue, Toronto, Ontario, Canada, M6M 1J4

[21] Appl. No.: 586,373

[22] Filed: Jan. 17, 1996

[30] Foreign Application Priority Data

Jan. 19, 1995 [CA] Canada ..... 2140611

[51] Int. Cl.[6] ..... A47K 3/22

[52] U.S. Cl. ..... 4/601; 4/615

[58] Field of Search ..... 4/601, 615, 596, 4/597, 605, 558, 608, 557, 607, 609, 612, 614

[56] References Cited

U.S. PATENT DOCUMENTS

| | | | |
|---|---|---|---|
| 1,207,380 | 12/1916 | Duffy | 4/601 |
| 1,255,396 | 2/1918 | Eaton | 4/601 |
| 2,424,537 | 7/1947 | Aronheim | 4/558 |
| 3,822,826 | 7/1974 | Wilson | 239/267 |
| 3,913,839 | 10/1975 | Wilson | 239/267 |
| 4,554,690 | 11/1985 | Knapp et al. | 4/615 |

FOREIGN PATENT DOCUMENTS

| | | | |
|---|---|---|---|
| 157441 | 8/1914 | Canada . | |
| 1012703 | 6/1977 | Canada . | |
| 2056173 | 5/1993 | Canada . | |
| 4023592 | 9/1991 | Germany | 4/607 |
| 4304359 | 8/1994 | Germany | 4/608 |
| 2063952 | 6/1981 | United Kingdom | 4/607 |

OTHER PUBLICATIONS

*Zygon International* Catalogue—p. 58.

*Primary Examiner*—Henry J. Recla
*Assistant Examiner*—Charles R. Eloshway
*Attorney, Agent, or Firm*—Rogers & Milne

[57] ABSTRACT

A shower fixture for mounting at least two generally horizontally spaced-apart shower heads to a single shower outlet. The fixture has at least two spaced-apart shower heads and a fluid conduit connecting the shower heads to a common fluid inlet and providing fluid communication between each of the shower heads and the fluid inlet. The fixture further has a connector for connecting the fluid inlet to the shower outlet and providing fluid communication therebetween. The fixture also has at least one fluid flow interruptor for interrupting fluid flow through at least one of the shower heads.

6 Claims, 2 Drawing Sheets

DUAL SHOWER FIXTURE

FIELD OF THE INVENTION

This invention relates to plumbing fixtures and more particularly to shower fixtures

BACKGROUND OF THE INVENTION

In most bathrooms having a bathtub, the tub is partially surrounded by a tub enclosure having two ends walls and a side wall. The tub enclosure generally features a shower head attached to a shower outlet extending from one of the end walls, usually above the tub faucet and taps.

Although there is generally ample room in a tub enclosure for two people to shower simultaneously, as there is only one shower head the two people must alternate positions to take turns under the shower head. This has several disadvantages. Firstly, the person who is not under the shower head will generally become cold awaiting their turn. Secondly, the time required for showering is not significantly diminished over the time required for each of the persons to individually shower. Furthermore, there is a tendency for soap to rub off from one person to the other person as they are exchanging positions. Also, as there is only one shower head, the enclosure cannot be partitioned to make two individual shower stalls.

Ordinarily in situations where more than one shower head is mounted in an enclosure, such as for example in locker rooms, each shower head has a separate hot and cold water supply with individual taps. Although such an arrangement may be mounted in a tub enclosure, it is relatively expensive as such mounting requires the services of a person skilled in plumbing. Also, in many domestic environments, if separate sets of taps are used for two shower heads, adjusting the taps for one shower head may affect the temperature of the water emerging from the other shower head.

Although vertically spaced-apart shower heads (i.e. one above the other) are known, these would of course be of no assistance in enabling two people to shower simultaneously.

SUMMARY OF THE INVENTION

A shower fixture for mounting at least two generally horizontally spaced-apart shower heads to a single shower outlet. The fixture has at least two spaced-apart shower heads and a fluid conduit connecting the shower heads to a common fluid inlet and providing fluid communication between each of the shower heads and the fluid inlet. The fixture further has a connector for connecting the fluid inlet to the shower outlet and providing fluid communication therebetween. The fixture also has at least one fluid flow interruptor for interrupting fluid flow through at least one of the shower heads.

DESCRIPTION OF DRAWINGS

Preferred embodiments of the invention are described below with reference to the accompanying drawings in which.

DESCRIPTION OF PREFERRED EMBODIMENTS

Figure 1:
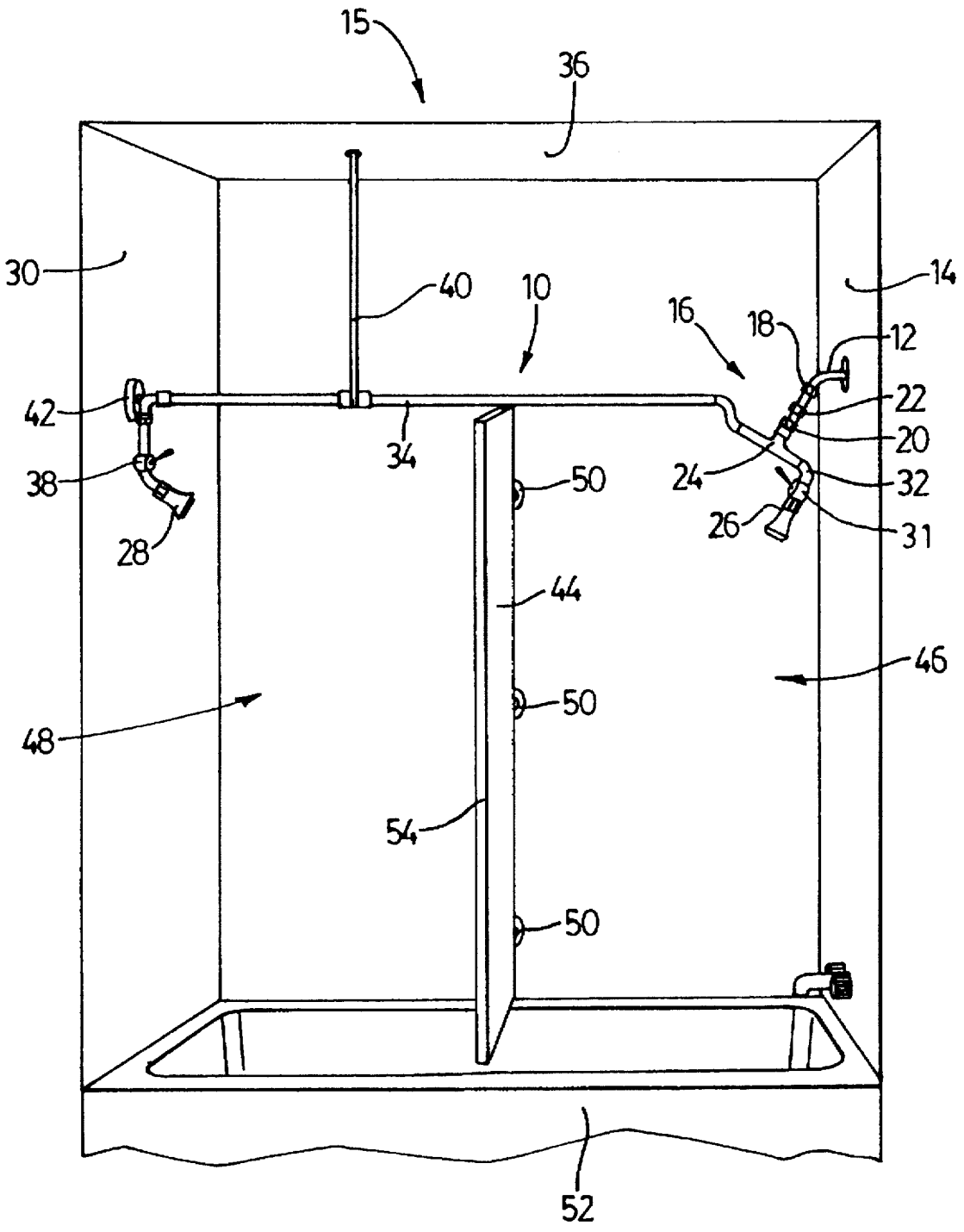
FIG. 1 is a perspective view of a device according to the present invention mounted in a tub enclosure.

A shower fixture according to the present invention is generally indicated by reference 10. The fixture is mounted to a shower outlet 12 which is essentially a downwardly curved section of pipe or tubing extending from an end wall 14 of a tub enclosure 15. The shower outlet 12 is connected to a water supply (not shown) which provides hot and cold water to the shower outlet 12.

The shower fixture 10 is attached to the shower outlet 12 by a pipe coupling generally indicated by reference 16. The pipe coupling has a first portion 18 which threads onto the shower outlet 12 and a second portion 20 which connects to a fluid inlet 24 of the shower fixture 10. A threaded collar 22 releasably connects the first portion 18 to the second portion 20 to enable the shower fixture 10 to be attached to or removed from the shower outlet 12. The coupling 16 acts as a connector for connecting the fluid inlet 24 to the shower outlet 12.

The shower fixture 10 has two shower heads 26 and 28. With the shower fixture 10 installed, the two shower heads 26 and 28 are spaced apart horizontally or laterally (as opposed to vertically) with the first shower head 26 adjacent the end wall 14 and the second shower head 28 adjacent the opposite end wall 30. The shower heads 26 and 28 are connected to the fluid inlet 24 by a fluid conduit having a first branch 32 and a second branch 34. The first branch 32 is configured to locate the shower head 26 against the end wall 14. The second branch 34 is configured to extend across a top 36 of the tub enclosure and locate the shower head 28 adjacent the opposite end wall 30.

A fluid flow interruptor in the form of a valve 38 is mounted in the second branch 34 of the fluid conduit adjacent the second shower head 28. The valve 38 may be used to interrupt fluid flow to the second shower head 28 if it is desired to use ony shower head 26.

Figure 2:
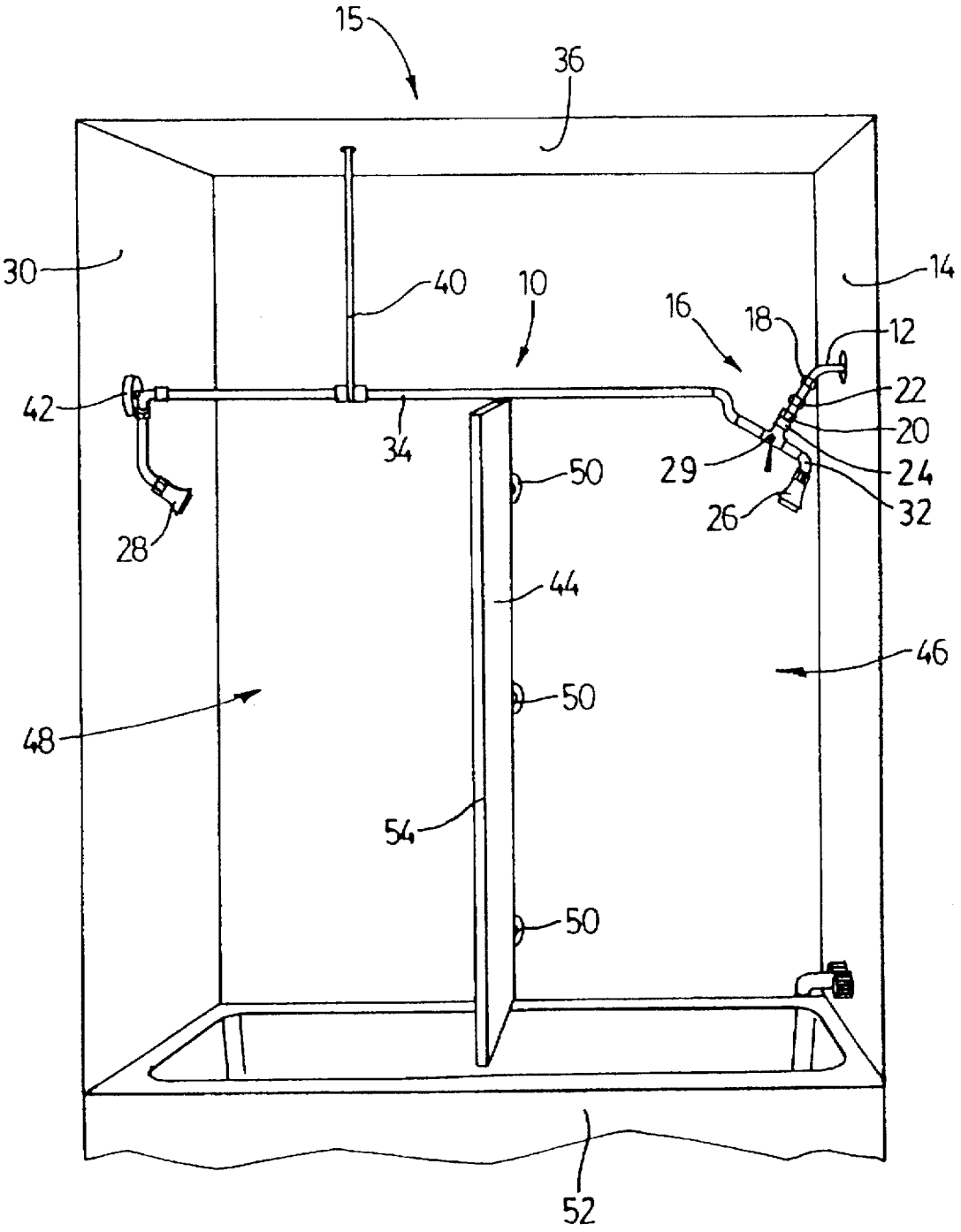
FIG. 2 is a perspective view of the device showing a single diverter valve arrangement.

Other configurations of fluid flow interruptor would be apparent to persons skilled in the art. For example, a valve may be mounted adjacent the first shower head 26 (FIG. 1), valves may be mounted adjacent each of the shower heads 26 and 28 or a diverter valve 29 may be mounted between the first branch 32 and second branch 34 of the fluid conduit (FIG. 2) to provide fluid flow to either or both of the shower heads 26 and 28.

In order to reduce strain on the shower outlet 12 arising from the weight of the shower fixture 10, securing means such as shown at 40 and 42 may be provided. The securing means at 40 is a conventional pipe hanger having a U-shaped stirrup suspended from the top 36 of the tub enclosure 15. Alternatively, the securing means at 42 may be a suction cup as shown or a resilient pad which presses against the end wall 30. Alternatively, the elbow adjacent reference 42 may be provided with flanges extending laterally therefrom through which fasteners may be secured into the adjacent end wall 30.

If desired, a modesty .partition 44 may be mounted in the tub enclosure to divide the enclosure into two shower stalls 46 and 48. The modesty partition 44 may be a shower curtain or other suitable partition wall, preferably releasably installable in the tub enclosure 15 such as by suction cups 50. The modesty partition 44 will generally not extend all of the way across the width of the bathtub 52 so as not to interfere with a shower curtain (not shown) which would ordinarily have its lower edge inserted in the bathtub 52 along the outer wall. To further ensure privacy, the shower curtain and an outer edge 54 of the modesty partition 44 may be provided with respective portions of interactive fasteners to fasten the shower curtain to the outer edge 54. Suitable interactive fasteners would include hook and loop fasteners (such as sold under the trade mark VELCRO™), dome fasteners and magnetic fasteners.

In use the shower fixture may be used much the same as a conventional shower head by supplying water to the shower outlet 12 at a suitable temperature and pressure. The shower heads 26 and 28 fluidly communicate with the shower outlet 12 through the pipe coupling 16 and the first branch 32 and second branch 34 of the fluid conduit. If it is desired to use only one of the shower heads, fluid flow to the other shower head 28 may be interrupted by closing the valve 38.

The shower heads 26 and 28 may be of the water-saving type if it is desired to minimize water usage or if there is not enough pressure to adequately supply two conventional shower heads.

It is intended that the above description should be interpreted in an illustrative rather than a restrictive sense. Variations may be apparent to appropriately skilled persons while staying within the spirit and scope of the invention as defined by the claims set out below.

I claim:

1. A shower assembly mountable in a tub enclosure having opposite end walls, a rear wall extending between said opposite end walls, a top extending between said opposite end walls, and a shower outlet extending outwardly and downwardly through one of said opposite end walls and into said enclosure, said shower assembly comprising:

at least two spaced-apart shower heads;

a rigid fluid conduit connecting said shower heads to a common fluid inlet and providing fluid communication between each said shower head and said fluid inlet;

a connector for connecting said fluid inlet to said shower outlet and providing fluid communication there between such that said fluid inlet extends from said shower outlet and suspendingly supports at least part of said rigid conduit;

at least one fluid flow interrupter for interrupting fluid flow to at least one of said shower heads;

said fluid conduit having two branches;

one of said two branches being configured to locate one of said shower heads adjacent and facing away from said one of said opposite end walls when said fluid inlet is connected to said shower outlet;

the other of said branches being configured to extend upwardly from said fluid inlet, across said top of said tub enclosure and downwardly to locate the other of said shower heads adjacent and facing away from the other of said opposite end walls of said tub enclosure when said fluid inlet is connected to said shower outlet.

2. A shower assembly as claimed in claim 1 wherein said connector is a pipe coupling having an end connectable to said shower outlet and an opposite end connected to said fluid inlet; and, each said at least one fluid flow interrupter is a valve mounted in said fluid conduit between said fluid inlet and the respective one of said shower heads to which it interrupts flow.

3. A shower assembly as claimed in claim 2 in association with a modesty partition having first releasable securing means to secure said modesty partition to said tub enclosure without marring said enclosure, said modesty partition when mounted extending substantially across said tub enclosure to divide said tub enclosure into two shower stalls while providing sufficient clearance to enable a shower curtain to be inserted past an outer edge of said modesty partition into said tub.

4. A shower assembly as claimed in claim 1 wherein said at least one fluid flow interrupter is a diverter valve mounted between said fluid inlet and said conduit, said diverter valve being moveable between a first position enabling fluid to flow into one of said branches and a second position enabling fluid to flow into both of said branches.

5. A shower assembly as claimed in claim 4 in association with a modesty partition having first releasable securing means to secure said modesty partition to said tub enclosure without marring said enclosure, said modesty partition when mounted extending substantially across said tub enclosure to divide said tub enclosure into two shower stalls while providing sufficient clearance to enable a shower curtain to be inserted past an outer edge of said modesty partition into said tub.

6. A shower assembly as claimed in claim 1 in association with a modesty partition having first releasable securing means to secure said modesty partition to said tub enclosure without marring said enclosure, said modesty partition when mounted extending substantially across said tub enclosure to divide said tub enclosure into two shower stalls while providing sufficient clearance to enable a shower curtain to be inserted past an outer edge of said modesty partition into said tub.

* * * * *